United States Patent [19]

Crawford

[11] Patent Number: 5,013,970

[45] Date of Patent: May 7, 1991

[54] PEAK VOLTAGE REDUCER CIRCUIT FOR FLUORESCENT LAMPS

[75] Inventor: Joseph A. Crawford, Chicago, Ill.

[73] Assignee: North American Philips Corporation, New York, N.Y.

[21] Appl. No.: 290,925

[22] Filed: Dec. 28, 1988

[51] Int. Cl.[5] ..... H05B 41/14; H05B 41/36

[52] U.S. Cl. ..... 315/106; 315/101; 315/107; 315/DIG. 5; 315/187

[58] Field of Search ..... 315/101, 106, 107, DIG. 5, 315/187, 188, 232, 323

[56] References Cited

U.S. PATENT DOCUMENTS

| | | | |
|---|---|---|---|
| 3,080,503 | 3/1963 | Brooks | 315/187 |
| 3,954,316 | 5/1976 | Luchetta | 315/187 X |
| 4,010,399 | 3/1977 | Bessone et al. | 315/101 |
| 4,399,391 | 8/1983 | Hammer et al. | 315/106 X |
| 4,415,837 | 11/1983 | Sodini | 315/DIG. 5 X |
| 4,425,530 | 1/1984 | Hammer et al. | 315/100 X |
| 4,517,498 | 5/1985 | Crawford | 315/323 |
| 4,661,745 | 4/1987 | Citino et al. | 315/106 |
| 4,847,536 | 7/1989 | Lowe et al. | 315/106 X |

*Primary Examiner*—Eugene R. LaRoche
*Assistant Examiner*—D. Hyun Yoo
*Attorney, Agent, or Firm*—Robert T. Mayer

[57] ABSTRACT

A rapid start fluorescent system which has its starting capacitance connected to a tap on the secondary of the ballast transformer which tap is located at a predetermined number of turns of the secondary.

2 Claims, 1 Drawing Sheet

PEAK VOLTAGE REDUCER CIRCUIT FOR FLUORESCENT LAMPS

Figure 1:
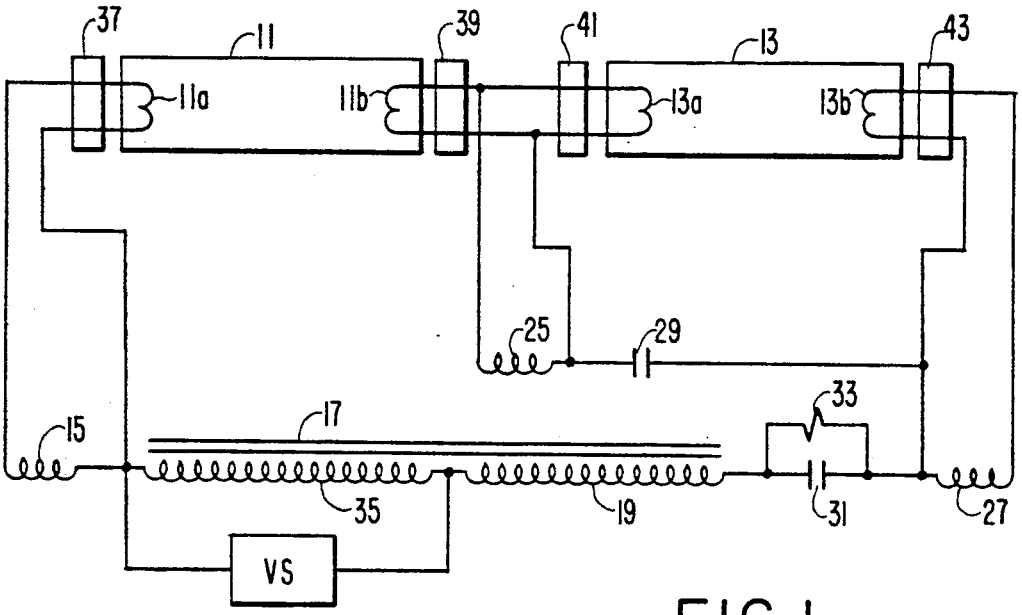
FIG. 1 PRIOR ART

This is an invention in lighting. More particularly it involves an arrangement for a rapid start fluorescent lamp system which complies with industry standards of safety for non-electronic ballasts.

Rapid start fluorescent lamp systems are well known. Some of these systems employ heater transformers with electrode heater windings for heating the electrodes of lamps. To save energy in these systems it has been proposed in the past to use a voltage sensitive switch in the heater transformer primary circuit to open the heater transformer primary circuit after the lamps turn on. With such an arrangement the electrode heater windings being secondary windings cease conducting when the primary winding circuit is opened. This conserves energy by turning off electrode heating current after lamp turn on. A problem which has been experienced with rapid start circuits using heater transformers is that the voltage potential to ground from each lamp holder terminal upon the removal of one of the lamps may exceed the maximum peak voltage set for safety standards.

It is an object of this invention to comply with industry safety standards.

It is another object of this invention to discontinue electrode heating current in fluorescent lamps after turn on and still comply in all respects with industry safety standards.

One of the advantages of the invention is that the arrangement involved in accomplishing the above objects is straight forward and inexpensive.

One of the features of the invention is that it facilitates making engineering specification changes which may be desirable in different locations.

In accordance with one embodiment of the invention there is provided a rapid start fluorescent lamp system including a source of voltage and at least two fluorescent lamps connected in series for operation. Each lamp has a pair of electrodes. A pair of terminals is provided for each lamp for connecting to the source of voltage. Also provided are a plurality of electrode heater windings connected to the source of voltage and to the electrodes to heat them. A capacitor and a predetermined amount of impedance are connected in series and both the capacitor and the predetermined amount of impedance is connected in parallel with one of the lamps.

The invention also comprises a heating transformer including a primary heater winding connected in series with a voltage sensing element. The primary heater winding and the voltage sensing element are connected in parallel with the series connected lamps. The voltage sensing element disconnects the heating transformer primary winding from the voltage source after the lamps have started. The capacitor and the predetermined amount of impedance comprise a voltage reduction means for maintaining the voltage on each terminal of the lamps below a prescribed maximum upon removal of one of the lamps from connection with its terminals during operation.

Figure 2:
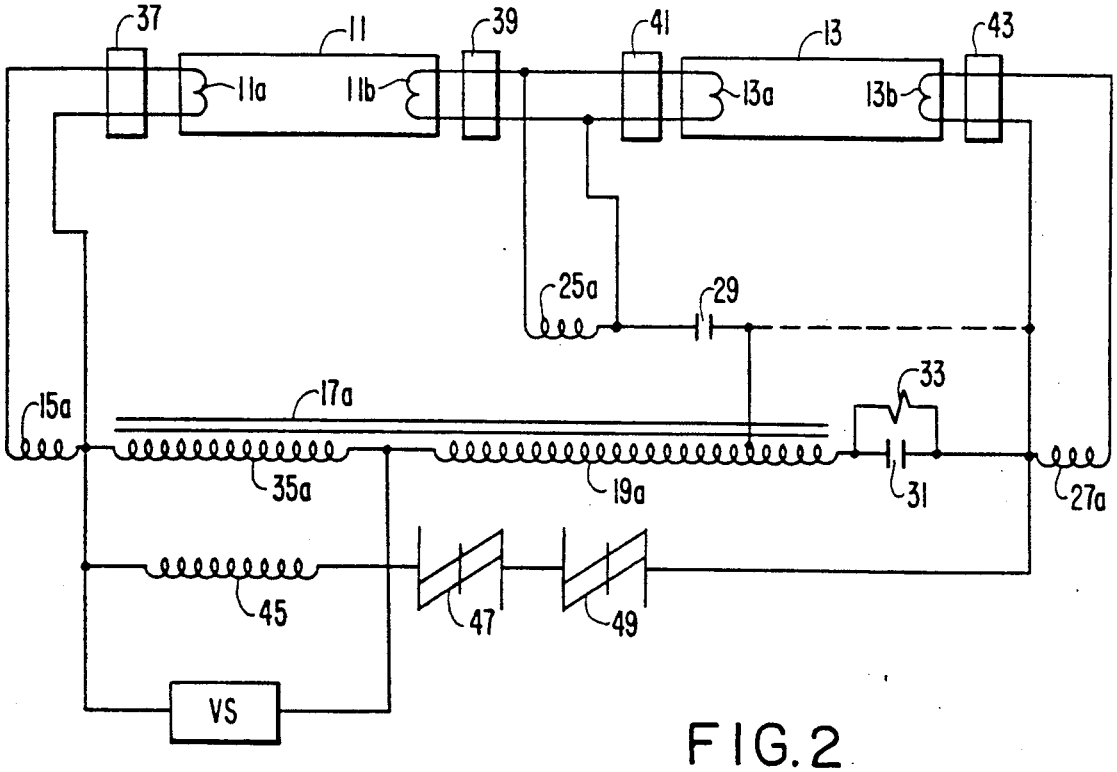

Other objects, features and advantages of the invention will be apparent from the following description and appended claims when considered in conjunction with the accompanying drawing in which:

FIG. 1 is a schematic circuit diagram for a so-called two lamp rapid start fluorescent system with a leading power factor auto transformer; and FIG. 2 is a schematic circuit diagram of a so-called two lamp rapid start fluorescent system embodying the features of the invention including a separate heater transformer.

Referring specifically to FIG. 1, there is shown therein two series connected fluorescent lamps 11 and 13 each having a pair of electrodes 11*a*, 11*b* and 13*a*, 13*b*, respectively. As is typical, electrode 11*a* is connected across winding 15 of auto transformer 17. Electrodes 11*b* and 13*a* of lamps 11 and 13 are connected in parallel and both are connected across heater winding 25. Electrode 13*b* of lamp 13 is connected across heater winding 27. Connected between electrodes 13*a* and 13*b* of lamp 13 is starting capacitor 29.

Connected between secondary winding 19 and heater winding 27 is power capacitor 31 and its bleeder resistance 33. Primary winding 35 of transformer 17 is connected across voltage source VS.

As those skilled in the art will understand lamps 11 and 13 have their electrodes connected through lamp holder terminals 37, 39, 41, and 43. In a two lamp rapid start fluorescent system such as shown in FIG. 1 safety requirements dictate that the voltage potential to ground from each lamp holder terminal not exceed 175 volts RMS and 325 volts peak during the condition of one lamp operating such as when the other lamp is removed from the circuit.

In FIG. 2 a variation of the rapid start system of FIG. 1 is shown. The same elements in FIG. 2 that appear in FIG. 1 have been given the same reference characters. Those that are similar but not the same have been designated with the same reference characters but have had the suffix "a" added to them to distinguish between the elements of the two figures.

FIG. 2 includes a heater transformer whose primary 45 is connected in series with two SIDACs 47 and 49 which form a voltage sensing means. Primary 45 and SIDACs 47 and 49 are connected in parallel across lamps 11 and 13 and across the primary 35*a* and secondary 19*a* of ballast inductance 17*a* together with its power capacitor and bleeder resistance 33. Secondary heater transformer winding 15*a*, 25*a*, and 27*a* provide heating voltage for electrodes 11*a*, 11*b*, 13*a*, and 13*b*. In addition starting capacitor 29 in the circuitry of FIG. 2 is not connected to electrode 13*b* (as shown in dotted line) but rather to a tap on the secondary 19*a* of ballast inductance 17*a* (as shown in solid line). The reason for this change will be described hereinafter.

As those skilled in the art will understand the voltage sensing means formed by SIDACs 47 and 49 acts as a closed switch during starting of the lamps to allow current to flow through primary 45 so that secondaries 15*a*, 25*a* and 27*a* can provide heater current to the electrodes of lamps 11 and 13. After the lamps have started and while they are operating the voltage sensing means acts to open the circuit to primary 45 thereby turning off the electrode heater power and conserving electrical power while the lamps are operating.

In a constructed embodiment of the circuitry of FIG. 2 with two 40 watt lamps, the heater transformer had a primary 45 with 2,645 turns and secondaries 15*a*, 25*a*, and 27*a* with 65 turns, 70 turns, and 63 turns respectively. One of SIDACs 47 and 49 had a break over voltage of 110 volts and the other a break over voltage of 380 volts. As a result primary 45 conducted only after a voltage of 490 volts appeared across it and SIDACs 47 and 49. Conduction ceased at approximately 260 volts. Primary 35*a* of ballast 17*a* had 866 turns and secondary 19*a* had 1,432.5 turns. With capacitor 29 connected to electrode 13*b* as is shown by dotted line and not to the tap on secondary 19*a*, as shown by solid line, it was found that a 120 volt 60 cycle source caused the peak voltages to ground at lamp holder terminals 41 and 43 to exceed the maximum 325 volt peak permitted for safety reasons when lamp 13 was removed from the circuit. In order to reduce this voltage a tap was placed on secondary 19*a* so as to have 1,371 turns on the primary side of this tap and 61.5 turns on the power capacitor 31 side of the tap. When capacitor 29 is connected to this tap as shown by solid line in FIG. 2 sufficient impedance is added to the circuits from terminals 41 and 43 to ground when lamp 13 is removed from the circuit during operation so that the circuit in fact complies with the safety requirements.

As is evident compliance with safety requirements has been obtained in a straight forward and inexpensive manner by simply connecting starting capacitor 29 to a tap on secondary 19*a* with a predetermined number of turns between the tap and power capacitor 31. As is evident engineering specifications for the voltages that will appear at terminals 37, 39, 41, and 43 may be changed readily by changing the number of turns between the tap and power capacitor 31.

It should be apparent that modification of the above will be evident to those skilled in the art and that the arrangements described herein are for illustrative purposes and are not to be considered restrictive.

What is claimed is:

1. A rapid start fluorescent lamp system including a source of voltage and at least two fluorescent lamps connected in series for operation, each lamp having a pair of electrodes, a pair of terminals for each lamp, each pair of terminals being connected to an associated pair of electrodes and connecting its associated pair of electrodes to said source of voltage, a plurality of electrode heater windings connected to said source of voltage and to said electrodes to heat said electrodes, a ballast transformer with a primary winding and a secondary winding connected in series, said ballast transformer windings being connected in parallel with said lamps, a starting capacitor and a predetermined amount of impedance connected in series, said starting capacitor and said predetermined amount of impedance being connected in parallel with one of said lamps, said predetermined amount of impedance being a predetermined number of turns of said ballast secondary winding, said predetermined number of turns being selected so that said starting capacitor and said predetermined number of turns in combination comprise a voltage reduction means which functions to maintain the voltage on the terminals of the lamps below a prescribed maximum upon removal of one of the lamps from connection with its terminals during operation.

2. A rapid start fluorescent lamp system as claimed in claim 1, including a heating transformer with a primary winding and a plurality of secondary windings comprising said electrode heater windings and a voltage sensing means connected in series with said heating transformer primary winding, said heating transformer primary winding and said voltage sensing means being connected in parallel with said series connected lamps and to said voltage source while said lamps are starting, said voltage sensing means disconnecting said heating transformer primary winding from said voltage source after said lamps have started.

* * * * *